US006446918B1

(12) United States Patent
Knight

(10) Patent No.: US 6,446,918 B1
(45) Date of Patent: Sep. 10, 2002

(54) SUPPORTING FRAME FOR FLEXIBLE DEBRIS CONTAINER

(76) Inventor: Ronit Knight, 4642 Sparrows Nest, San Antonio, TX (US) 76250

( * ) Notice: Subject to any disclaimer, the term of this patent is extended or adjusted under 35 U.S.C. 154(b) by 0 days.

(21) Appl. No.: 09/597,051

(22) Filed: Jun. 20, 2000

(51) Int. Cl.[7] ..... B65B 67/04
(52) U.S. Cl. ..... 248/99; 248/101
(58) Field of Search ..... 248/99, 101, 95; 141/390

(56) References Cited

U.S. PATENT DOCUMENTS 3,893,649 A * 7/1975 Cornell et al. ..... 348/97
4,037,778 A * 7/1977 Boyle ..... 229/55
4,664,348 A * 5/1987 Corsaut, III et al. ..... 248/99
4,760,982 A * 8/1988 Cooke ..... 248/99
4,884,603 A * 12/1989 Simpson ..... 141/390
5,065,965 A * 11/1991 Aulabaugh ..... 248/99
5,080,308 A * 1/1992 Franks ..... 248/99
5,129,609 A * 7/1992 Tobin ..... 248/97
5,913,496 A * 6/1999 Valdez ..... 248/99
6,086,022 A * 7/2000 Dalton ..... 248/99
6,189,841 B1 * 2/2001 LaPoint et al. ..... 248/99

* cited by examiner

*Primary Examiner*—Ramon O. Ramirez
*Assistant Examiner*—A Joseph Wujciak
(74) *Attorney, Agent, or Firm*—Rosenman & Colin LLP

(57) ABSTRACT

An apparatus for collection and holding debris in a flexible container includes a platform having a right panel, a center panel and a left panel. Each of the right panel and the left panel are at an angle to a plane defined by the center panel. There is a protrusion from the left side of the center panel and from the right side of the center panel and a ring attached to the platform.

2 Claims, 2 Drawing Sheets

SUPPORTING FRAME FOR FLEXIBLE DEBRIS CONTAINER

FIELD OF THE INVENTION

This invention relates to leaf collection and, more specifically, to a bag and frame combination for use in yards that facilitates the collecting and discarding of leaves, grass trimmings, and other garden and lawn debris by a single individual.

BACKGROUND OF THE INVENTION

Large plastic or other fabric bags are widely used for collecting and discarding leaves, grass trimmings and other garden and lawn debris. However, plastic or other flexible collection bags are extremely pliable. As such, it is difficult for a single worker to both hold the mouth of the bag open and to rake leaves into the bag or otherwise fill it. Some attempts have been made to provide frames for temporarily supporting the bag with the mouth open.

U.S. Pat. No. 5,011,103 (Hayes) discloses an elaborate bag and frame combination that supports a garbage bag in an open state while the bag lies horizontally on the ground using flexible rods. U.S. Pat. No. 4,759,519 (Cheng) discloses a rectangular frame which only collapses with a degree or difficulty and presents an impediment to raking the leaves into the bag. U.S. Pat. No. 4,749,000 (Rylander) discloses a pliable sheet which is rolled up into a substantially cylindrical configuration and inserted inside the bag, whereby the bag is kept open by the sheet's tendency to flatten out. This device is not collapsible and does not provide any means for securing the bag to the ground or preventing it from rolling with use. U.S. Pat. No. 4,664,348 (Corsaut, III) discloses a plastic strip with operation similar to a cross-section of the device in Rylander. U.S. Pat. No. 3,744,081 (Miller) discloses a collapsible and adjustable three-sided frame to be inserted in the bag's mouth which presents an impediment of the raking or sweeping of debris into the bag. It does not include any provision to prevent the apparatus from toppling over. The other references are illustrative of other approaches.

SUMMARY OF THE INVENTION

An embodiment of the present invention is an apparatus for collection and holding debris in a flexible container, including (1) a platform including a right panel, a center panel and a left panel wherein each of the right panel and the left panel are at an angle to the plane defined by the center panel, (2) a protrusion from the left side of said center panel, (3) a protrusion from the right side of said center panel and (4) a ring attached to said platform.

BRIEF DESCRIPTION OF THE DRAWINGS

The foregoing and other objects and advantages of the invention will be appreciated more fully from the following further description thereof with reference to the accompanying drawings wherein.

DETAILED DESCRIPTION

Figure 1:
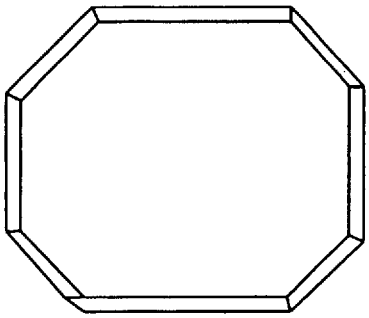
FIG. 1 is a perspective view of the inner ring used in a preferred embodiment of the invention.
Figure 2A:
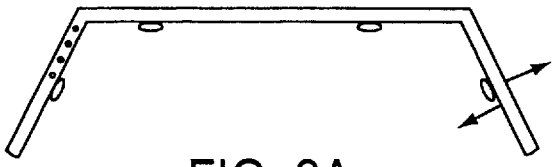
FIG. 2 is a perspective view of the outer ring used in a preferred embodiment of the invention.
Figure 2B:
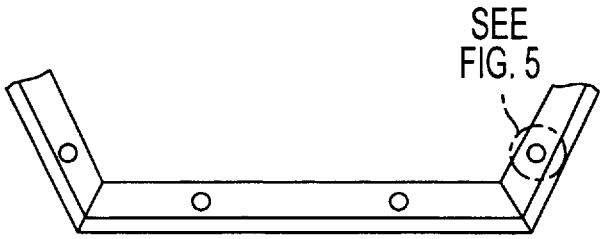
Figure 5:
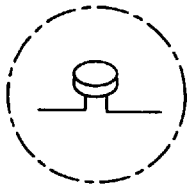
FIG. 5 is a perspective view of the raised button used in a preferred embodiment of the invention.
Figure 6:
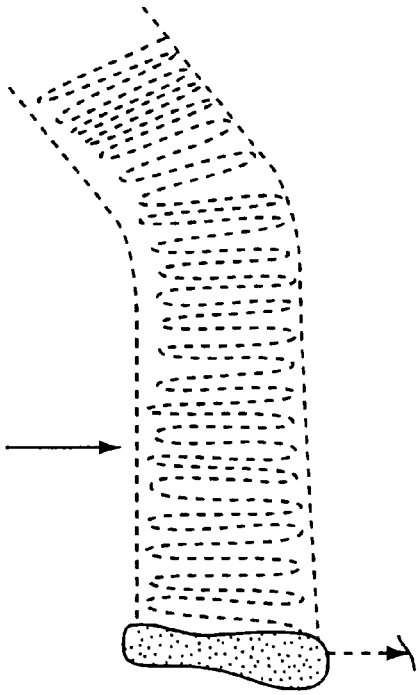
FIG. 6 is a perspective view of the inner ring used in a preferred embodiment of the invention.
Figure 7:
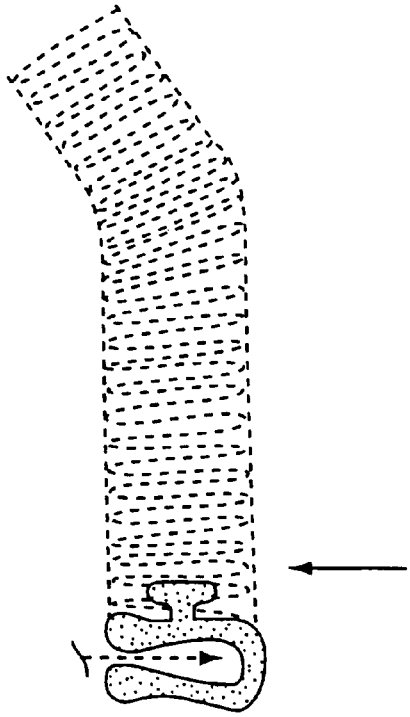
FIG. 7 is a perspective view of the outer right used in a preferred embodiment of the invention.

As shown in FIG. 1 and FIG. 6, the inner ring 2 is an octagonal-shaped band that in one preferred embodiment is two inches wide. The inner ring 2 may be made of polyvinyl chloride or any other type of common plastic. As further shown in FIG. 2 and FIG. 7 the outer right 25 if one and one-half inches wide. As FIG. 2 illustrates, there are four bottons 16, 18, 20, and 22 along the interior surface of the outer ring 25. As FIG. 7 illustrates the outer ring 25 has a torus-like shape, which open along the interior circumference of the torus. As shown in FIG. 7, the opening is flanked by two swellings that are complements to the inner ring 2.

Figure 4:
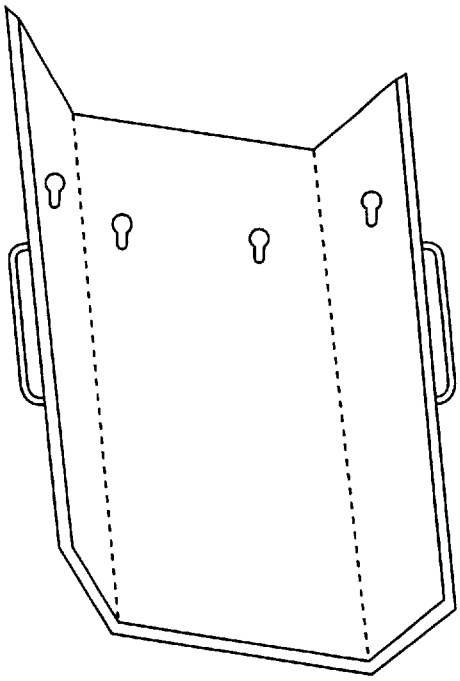
FIG. 4 is a perspective view of the platform used in a preferred embodiment of the invention.
Figure 3:
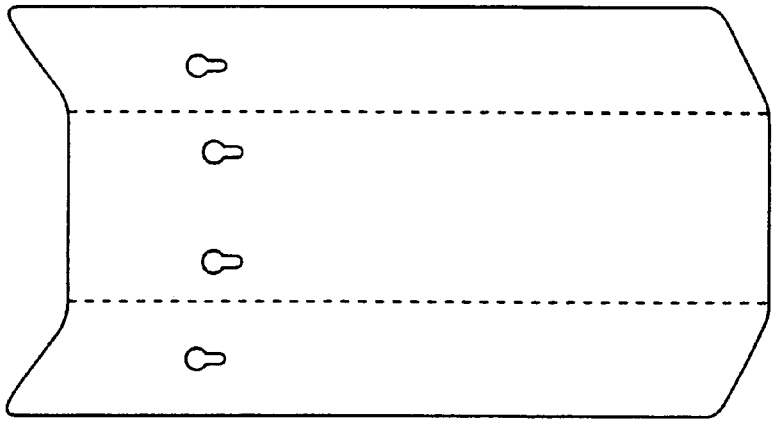
FIG. 3 is a plan view of the platform used in a preferred embodiment of the invention.

As shown in FIG. 3 and FIG. 4, the third component of the preferred embodiment of the invention is the platform 3. The platform 3 may be made of polyvinyl chloride or any other type of common plastic. The platform 3 includes three panels: a left panel 9, a center panel 11 and a right panel 13. Each panel extends an angle of between zero to ninety degrees from the center panel 11.

As FIG. 3 shown on each of the left panel 9 and the right of panel 13 is button hole 8 and button hole 14, respectively. In the center panel 11 are two button holes 10 and 12.

In operation, the rim of a garbage bag would be pulled over the inner ring 2. The main body of the garbage bag would rest on the interior of the inner ring 2.

The outer ring 25 would be then snapped over in the inner ring 2 trapping the rim of the garbage bag in a fixed position with respect to the inner ring/outer ring assembly.

The platform 3 would be adjusted so that the button holes 8, 10, 12 and 14 in the platform 3 fitted in a locked position with the corresponding buttons 16, 18, 20 and 22. The garbage bag would be spread out to lie on the platform. The user of the complete assembly would straddle the assembly and press down on the pedals 4 and 6 with his or her feet to stabilize the assembly. Once the garbage is full, of the user stands the garbage bag upright and ties the opening of the garbage bag. The user then disassembles the assembly and disposes of the full garbage bag.

It should be understood, however, that the foregoing description of the invention is intended merely as to be illustrative thereof and the other modifications and embodiments may be apparent to those skilled in the art without department from its spirit.

What is claimed:

1. An apparatus for collecting and holding debris in a flexible container, having a mouth, comprising:

a platform including a right panel, a center panel and a left panel wherein each of the right panel and the left panel are at an angle to the plane defined by the center panel;

a protrusion from the left side of said center panel;

a protrusion from the right side of said center panel;

a ring assembly attached to said platform; and said apparatus capable of holding said container mouth open while apparatus is in a substantially prone position.

2. The apparatus of claim 1, wherein said center panel contains raised button holes to lock said platform into position;

wherein said ring assembly has an outer ring with buttons for interlocking said ring assembly; and wherein said center panel functions as an extended loading ramp reinforced by said ring assembly.

* * * * *